US005679225A

United States Patent [19]

Pastacaldi et al.

[11] Patent Number: 5,679,225

[45] Date of Patent: Oct. 21, 1997

[54] ELECTRODE FOR AN ELECTROCHEMICAL PROCESS AND USE OF THE SAID ELECTRODE

[75] Inventors: Alessandra Pastacaldi; Francesco Posar, both of Rosignano-Solvay/Livorno, Italy

[73] Assignee: Solvay (Societe Anonyme), Brussels, Belgium

[21] Appl. No.: 541,529

[22] Filed: Oct. 10, 1995

[30] Foreign Application Priority Data

Oct. 11, 1994 [IT] Italy ..... MI94A2070

[51] Int. Cl.[6] ..... C25B 11/00

[52] U.S. Cl. ..... 204/290 R; 204/290 F; 204/291; 204/292; 204/293

[58] Field of Search ..... 204/290 R, 290 F, 204/291, 292, 293

[56] References Cited

U.S. PATENT DOCUMENTS 4,513,102 4/1985 Hutchings et al. ..... 204/290 F
4,626,334 12/1986 Ohe et al. ..... 204/290 R

*Primary Examiner*—Bruce F. Bell
*Attorney, Agent, or Firm*—Horst M. Kasper

[57] ABSTRACT

Electrode for an electrochemical process, comprising, on an electrically conductive substrate, a platinum, iridium oxide and tin oxide coating, the coating comprising more than 8% by weight of iridium oxide. Use of the said electrode as the anode in a process for electrolyzing an alkali metal salt in aqueous solution.

6 Claims, 1 Drawing Sheet

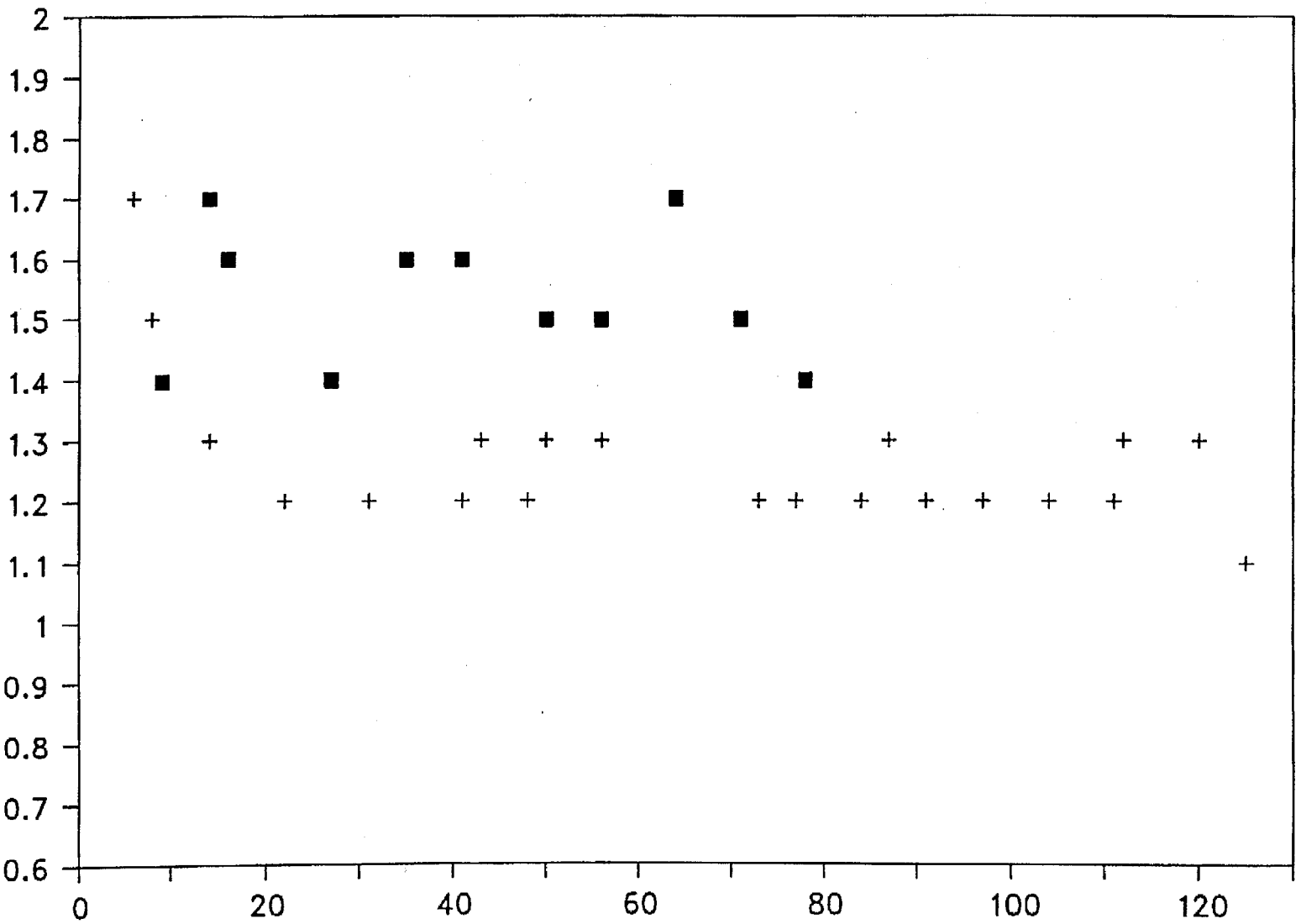
2
1.9
1.8
1.7
1.6
1.5
1.4
1.3
1.2
1.1
1
0.9
0.8
0.7
0.6
0
20
40
60
80
100
120

ELECTRODE FOR AN ELECTROCHEMICAL PROCESS AND USE OF THE SAID ELECTRODE

The invention relates to electrochemical processes, in particular electrolysis processes.

It more particularly relates to an electrode which can be used in such processes.

Important parameters in industrial electrolysis processes are, on the one hand, the electrochemical reaction potentials at the electrodes and, on the other hand, the current efficiency at the electrodes.

The difficulty in producing acceptable current efficiencies is present particularly in processes for electrolyzing salts of alkali metals in aqueous solution, since the reaction at the anode is normally accompanied by a parasitic formation of oxygen. This difficulty is present particularly in processes for manufacturing chlorine by electrolysis of aqueous solutions of alkali metal chloride (in particular sodium chloride).

The means used for reducing the parasitic production of oxygen in electrolysis processes consists in making use of anodes exhibiting a high overvoltage for oxidation of oxygen anions. To this end, in European Patent Application EP-A-0,153,586, anodes are proposed which comprise, on an electrically conductive substrate, a coating of ruthenium oxide and of tin oxide which are combined with platinum, platinum oxide or iridium oxide. Mention is moreover made of an anode whose coating consists of a mixture of 14 mol % of platinum, 6 mol % of iridium and 80 mol % of tin. In this known coating, the iridium and the tin are in the oxide state.

As regards the aforementioned known coating of platinum, of iridium oxide and of tin oxide, it has now been found that, by suitably modifying its relative contents of platinum, iridium oxide and tin oxide, it was possible to obtain an unexpected substantial increase in the overvoltage for oxidation of the oxygen anions and, consequently to improve the anodic current efficiency in processes for electrolyzing alkali metal salts in aqueous solution.

The invention therefore relates to an electrode for an electrochemical process, comprising, on an electrically conductive substrate, a platinum, iridium oxide and tin oxide coating, the said coating comprising more than 8% by weight of iridium oxide.

In the electrode according to the invention, the substrate should be made of an electrically conductive material which is inert under the electrolysis conditions for which the electrode is intended. Notwithstanding this condition, the substrate of the electrode according to the invention is not critical and its composition does not constitute the subject matter of the invention. By way of example, the substrate may advantageously be made of a metal selected from titanium, tantalum, zirconium, vanadium, niobium and tungsten, or made of an alloy of these metals.

The profile of the substrate is not critical and does not constitute the subject matter of the invention, with the most suitable profile depending on the intended use of the electrode and therefore needing to be determined in each particular case. By way of example, the substrate of the electrode according to the invention may be a rigid or flexible, solid or openworked plate, a wire, a mesh of interlaced wires or a stack of balls.

The coating must be present on the substrate in a quantity which is sufficient to cover a substantial part of the substrate and catalyze the electrochemical reaction for which the electrode is intended. The optimum quantity of coating will therefore depend on the electrochemical reaction for which the electrode is intended and it can be determined in each particular case by routine laboratory work. In practice, it is desirable for the coating to be present on the substrate in a quantity at least equal to 1 g (preferably 5 g) per $m^2$ of surface area of the substrate onto which it is applied. Although there is not in principle an upper limit for the thickness of the coating on the substrate, there is in practice no benefit in it exceeding 20 g per $m^2$ of the aforementioned surface area of the substrate, thicknesses from 8 to 12 $g/m^2$ being especially recommended.

In the electrode according to the invention, the platinum, the iridium oxide and the tin oxide are preferably distributed homogeneously in the coating. This expression is intended to mean that the relative concentrations of platinum, iridium oxide and tin oxide are substantially identical at all points in the coating or that they do not diverge by more than 5% (preferably 1%) between any two points in the coating.

Any suitable means can be used for applying the coating onto the substrate. One recommended means consists in applying onto the substrate a coat of thermally decomposable compounds of platinum, iridium and tin and in then subjecting the coat to a heat treatment in an oxidizing atmosphere, so as to decompose the thermally decomposable compounds and to form the coating. The thermally decomposable compounds may be any compounds which, when heated in an oxidizing atmosphere, release platinum or platinum oxide, iridium dioxide and tin dioxide. They may, for example, be selected from nitrates, sulphates, phosphates, halides and salts of carboxylic acids. In order to form the coat, the aforementioned thermally decomposable compounds can be employed in the solid state, for example in the state of a powder, or in the liquid state, for example in the form of molten salts, suspensions or solutions. The heat treatment consists by definition, in heating the coat to a sufficient temperature in a controlled oxidizing atmosphere to decompose the thermally decomposable compounds and coprecipitate platinum or platinum oxide, iridium oxide and tin oxide. The oxidizing atmosphere may consist of atmospheric air, enriched air or pure oxygen. Atmospheric air is preferably used. The choice of the thermally decomposable compounds and the heat-treatment temperature are interdependent. The choice of the thermally decomposable compounds is in particular influenced by the allowable temperature for the heat treatment, so as to prevent this treatment from damaging the substrate. In one advantageous embodiment of the invention, the thermally decomposable compounds are selected from halides and they are used in the dissolved state in an organic solvent. Chlorides are preferred, in particular iridium tetrachloride, tin tetrachloride and hexachloroplatinic acid, and the organic solvent is advantageously selected from alcohols, preferably aliphatic alcohols such as methanol, ethanol and isopropanol, for example. Temperatures of 100° to 1000° C. are in most cases suitable for carrying out the heat treatment, and those from 200° to 750° C. are especially recommended. When implementing this embodiment of the invention, it is generally recommended to apply several successive layers of the organic solution of the thermally decomposable compounds onto the substrate and to subject each layer individually to the heat treatment defined above.

According to the invention, selecting an iridium oxide content of more than 8% (preferably at least equal to 25%) of the weight of the coating makes it possible to increase the oxygen anion discharge overvoltage substantially, when the electrode according to the invention is used as the anode in a process for electrolyzing an aqueous solution of an alkali metal salt, in particular sodium chloride.

In a particular embodiment of the electrode according to the invention, the platinum content of the coating is at least 10% (preferably at least 12%) by weight. This embodiment of the electrode according to the invention has the additional advantage of exhibiting a weaker overvoltage for the electrochemical discharge of chloride anions and it is therefore especially suited for use as the anode in processes for electrolytic manufacture of chlorine.

The coating of the electrode may consist exclusively of platinum, iridium oxide and tin oxide, or else it may comprise one or more additional compounds other than platinum, iridium oxide and tin oxide. In general, it is preferable for the coating of the electrode according to the invention to consist essentially of platinum, iridium oxide and tin oxide.

In a preferred embodiment of the invention, the coating of the electrode essentially consists of from 12 to 17% by weight of platinum, from 30 to 40% by weight of iridium oxide and from 43 to 584 by weight of tin oxide. The electrode according to this embodiment of the invention is especially suitable as the anode for the production of chlorine by electrolysis of aqueous solutions of alkali metal chloride.

The invention therefore also relates to the use of the electrode according to the invention as the anode in processes for electrolyzing salts of alkali metals in aqueous solution, especially for the production of chlorine by electrolysis of aqueous solutions of alkali metal chloride. It more especially relates to the use of the electrode according to the invention as the anode for producing chlorine by electrolysis of an aqueous solution of sodium chloride.

BRIEF DESCRIPTION OF THE DRAWING

The FIGURE shows a comparison of the prior art electrode and the electrode of the invention as shown by reference to Examples 1 and 2.

The benefit of the invention will emerge from the description of the following examples, with reference to the single FIGURE of the appended drawing which is a diagram giving the comparative performances of an electrode according to the invention and of an electrode prior to the invention.

In the examples which are described below, electrodes were prepared comprising a titanium substrate and a coating of platinum, iridium oxide and tin oxide on the substrate. The substrate consisted of a mesh having the shape of a disc with area approximately 100 $cm^2$ and the coating was applied onto the entire surface area of the disc. In order to form the coating, three separate organic solutions were first prepared, namely a solution of hexachloroplatinic acid in isopropanol (30 g of hexachloroplatinic acid per liter of solution), a solution of iridium tetrachloride in isopropanol (20 g of iridium tetrachloride per liter of solution) and a solution of tin tetrachloride in isopropanol (23 g of tin tetrachloride per liter of solution). The three solutions were then mixed in suitable proportions to constitute the coat and the latter was then applied onto the disc in ten successive layers. After each coat layer was applied, the disc and the coat were heated in atmospheric air at a temperature of 450° C. for one hour.

The electrodes obtained as explained above were used as anodes in a laboratory electrolysis cell, the cathode of which consisted of a 100 $cm^2$ nickel disc separated from the anode by a membrane of the brand name NAFION® (DU PONT), which is selectively permeable to cations. The distance between the anode and the cathode was fixed at 1 mm. In order to evaluate the performances of the anode, a substantially saturated aqueous solution of sodium chloride was electrolyzed at 85° C. with an anodic current density of 3.5 $kA/m^2$. To this end, during the electrolysis, the anodic chamber of the cell was continuously fed with the sodium chloride solution, so as to produce in the cathodic chamber an aqueous solution of approximately 32% by weight of sodium hydroxide. In this way, chlorine was produced at the anode and hydrogen was produced at the cathode. In order to evaluate the performances of the anode, the oxygen content in the gas collected at the anode was measured. The results of the measurements were plotted on the diagram of the appended drawing. In this diagram, the abscissa scale represents time, expressed in days, and the ordinate scale represents the oxygen content in the gas produced at the anode (expressed in % by weight of gas).

EXAMPLE 1 (reference)

In this example, the solutions of hexachloroplatinic acid, of iridium tetrachloride and of tin tetrachloride were mixed in proportions suitable for the coating to have, after the heat treatment, the following composition by weight, which is that of the electrode used in Example 13 of Patent Application EP-A-0,153,586 mentioned above:

| | |
|---|---|
| Platinum: | 17%, |
| Iridium dioxide: | 8%, |
| Tin dioxide: | 75%. |

The change in the oxygen content in the gas collected at the anode over time is represented by the symbols ■ on the diagram of the drawing.

EXAMPLE 2 (according to the invention)

In this example, the solutions of hexachloroplatinic acid, of iridium tetrachloride and of tin tetrachloride were mixed in proportions suitable for the coating to have, after the heat treatment, the following composition by weight according to the invention:

| | |
|---|---|
| Platinum: | 15%, |
| Iridium dioxide: | 35%, |
| Tin dioxide: | 50%. |

The change in the oxygen content in the gas collected at the anode over time is represented by the symbols + on the diagram of the drawing.

Comparing the results of Examples 1 and 2 on the diagram of the drawing immediately shows the progress afforded by the invention.

We claim:

1. Electrode for an electrochemical process, comprising, on an electrically conductive substrate, a platinum, iridium oxide and tin oxide coating, wherein said coating consists essentially of 12–17% by weight of platinum, 30–40% by weight of iridium oxide, and 43–58% by weight of tin oxide.

2. Electrode according to claim 1, wherein the substrate is made of a metal selected from titanium, tantalum, zirconium, vanadium, niobium and tungsten, or made of an alloy of these metals.

3. A process for electrolyzing an alkali metal salt in aqueous solution on an electrode according to claim 1.

4. Process according to claim 3, for producing chlorine, the alkali metal salt being a chloride.

5. Process according to claim 4, in which the alkali metal is sodium.

6. Electrode for an electrochemical process, comprising, on an electrically conductive substrate, a platinum, iridium oxide and tin oxide coating, wherein said coating consists of 12–17% by weight of platinum, 30–40% by weight of iridium oxide, and 43–58% by weight of tin oxide.

* * * * *